US011626687B2

(12) United States Patent
Listing et al.

(10) Patent No.: US 11,626,687 B2
(45) Date of Patent: Apr. 11, 2023

(54) OSCILLATION SUPPRESSING CONNECTOR HOUSING AS WELL AS ELECTRICAL PLUG CONNECTOR AND ELECTRICAL PLUG CONNECTION WITH SUCH A CONNECTOR HOUSING

(71) Applicant: TE Connectivity Germany GmbH, Bensheim (DE)

(72) Inventors: Martin Listing, Bensheim (DE); Christoph Kosmalski, Bensheim (DE); Maximilian Veihl, Bensheim (DE); Sabine Schelhorn, Bensheim (DE)

(73) Assignee: TE Connectivity Germany GmbH, Bensheim (DE)

( * ) Notice: Subject to any disclaimer, the term of this patent is extended or adjusted under 35 U.S.C. 154(b) by 0 days.

(21) Appl. No.: 17/180,003

(22) Filed: Feb. 19, 2021

(65) Prior Publication Data

US 2021/0265773 A1 Aug. 26, 2021

(30) Foreign Application Priority Data

Feb. 20, 2020 (DE) ..... 10 2020 202 212.7

(51) Int. Cl.
*H01R 13/53* (2006.01)
*H01R 13/533* (2006.01)
(Continued)

(52) U.S. Cl.
CPC ..... *H01R 13/533* (2013.01); *H01R 13/424* (2013.01); *H01R 13/501* (2013.01)

(58) Field of Classification Search
CPC .. H01R 13/533; H01R 13/424; H01R 13/501; H01R 13/53; H01R 13/58;
(Continued)

(56) References Cited

U.S. PATENT DOCUMENTS 4,200,350 A * 4/1980 Zimmerman, Jr. .. H01R 13/424 439/752
4,203,643 A * 5/1980 Krolak ..... H01R 13/516 439/468
(Continued)

FOREIGN PATENT DOCUMENTS

DE 69505758 T2 7/1999
DE 102012111129 A1 5/2014
(Continued)

OTHER PUBLICATIONS

German Office Action, dated Oct. 15, 2020, 7 pages.
(Continued)

*Primary Examiner* — Harshad C Patel
(74) *Attorney, Agent, or Firm* — Barley Snyder

(57) ABSTRACT

A connector housing for an electrical plug connector includes a cable duct and an oscillation suppressor pivotable about a pivot axis into the cable duct. The cable duct receives an electrical cable of a predefined outer diameter along a plug-in direction. The cable duct in a cross section perpendicular to the plug-in direction has a clear dimension in a pivoted state of the oscillation suppressor in the cable duct equal to or less than the predefined outer diameter of the electrical cable.

17 Claims, 6 Drawing Sheets

(51) Int. Cl.
*H01R 13/424* (2006.01)
*H01R 13/50* (2006.01)

(58) Field of Classification Search
CPC ..... H01R 13/5816; H01R 13/5825; H01R 13/5829; H01R 13/5845; H01R 13/62933; H01R 13/62977
USPC ..... 439/382
See application file for complete search history.

(56) References Cited

U.S. PATENT DOCUMENTS 4,538,874 A * 9/1985 Dambach ..... H01R 24/62 439/426
5,141,452 A * 8/1992 Yoneda ..... H01R 13/4368 439/752
5,545,054 A 8/1996 Benes et al.
7,175,468 B1 2/2007 Chang
7,507,108 B2 * 3/2009 Tsuji ..... H01R 13/5841 439/446
7,794,267 B2 * 9/2010 Daily ..... H01R 12/721 439/402
7,922,503 B1 * 4/2011 Kobayashi ..... H01R 13/6295 439/157
8,007,298 B2 * 8/2011 Komiyama ..... H01R 13/4361 439/157
8,714,994 B2 * 5/2014 Daily ..... H01R 24/64 439/344
8,979,568 B2 * 3/2015 Herbrechtsmeier ..... H01R 13/62966 439/346
9,203,186 B2 * 12/2015 Shishikura ..... H01R 13/62977
9,793,636 B2 * 10/2017 France ..... H01R 9/2491
10,170,860 B2 * 1/2019 Johnson ..... H01R 13/64
11,237,342 B2 * 2/2022 Iizumi ..... G02B 6/3887
2007/0167066 A1 7/2007 Hara et al.
2009/0104822 A1 4/2009 Dietrich et al.
2010/0233900 A1 * 9/2010 Gimbel ..... H01R 13/5829 439/467
2011/0053421 A1 3/2011 Mostoller et al.
2013/0072054 A1 3/2013 Hotea et al.
2017/0331222 A1 11/2017 Draexlmaier
2018/0331451 A1 11/2018 Listing et al.
2020/0393630 A1 * 12/2020 Wong ..... G02B 6/3893

FOREIGN PATENT DOCUMENTS

DE 202016000102 U1 2/2016
JP 2016157619 A 9/2016

OTHER PUBLICATIONS

Abstract of DE102012111129A1, dated May 22, 2014, 1 page.
Abstract of DE202016000102U1, dated Feb. 4, 2016, 1 page.
Abstract of JP2016157619, dated Sep. 1, 2016, 1 page.
Extended European search report in Appln. No. 21158021.2-1201, dated Jun. 30, 2021, 12 pp.

* cited by examiner

OSCILLATION SUPPRESSING CONNECTOR HOUSING AS WELL AS ELECTRICAL PLUG CONNECTOR AND ELECTRICAL PLUG CONNECTION WITH SUCH A CONNECTOR HOUSING

CROSS-REFERENCE TO RELATED APPLICATION

This application claims the benefit of the filing date under 35 U.S.C. § 119(a)-(d) of German Patent Application No. 102020202212.7, filed on Feb. 20, 2020.

FIELD OF THE INVENTION

The present invention relates to an electrical plug connector and, more particularly, to a connector housing for an electrical plug connector.

BACKGROUND

In numerous applications in automotive engineering, electrically conductive contact elements are made to electrically contact by way of detachable plug connections for the transmission of electrical currents and signals. The current flow is effected in particular via mutually touching contact surfaces or contact points of the contact elements. For this purpose, the contact elements are each typically positioned and mounted in a suitable connector housing. For example, a certain play is provided for this positioning and mounting in order to compensate for manufacturing-related dimensional tolerances in the context of the installation of the contact elements.

Under operating conditions subject to vibrations, a frictional relative motion can be caused between the contact surfaces or contact points of the contact elements, which results in increased wear and abrasion on the contact elements. This can have a negative impact on the operating behavior of the electrical plug connections.

SUMMARY

A connector housing for an electrical plug connector includes a cable duct and an oscillation suppressor pivotable about a pivot axis into the cable duct. The cable duct receives an electrical cable of a predefined outer diameter along a plug-in direction. The cable duct in a cross section perpendicular to the plug-in direction has a clear dimension in a pivoted state of the oscillation suppressor in the cable duct equal to or less than the predefined outer diameter of the electrical cable.

BRIEF DESCRIPTION OF THE DRAWINGS

The invention will now be described by way of example with reference to the accompanying Figures, of which.

DETAILED DESCRIPTION OF THE EMBODIMENT(S)

Features and exemplary embodiments as well as advantages of the present disclosure will be explained in detail with respect to the drawings. It is understood that the present disclosure should not be construed as being limited by the description of the following embodiments. It should furthermore be understood that some or all of the features described in the following may also be combined in alternative ways.

The schematic structure of a connector housing 1 according to the invention shall first be explained with reference to FIG. 1. The schematic structure of an electrical plug connector 2 according to the invention shall thereafter be explained with reference to FIGS. 2 to 6. Finally, an electrical plug connection 4 according to the invention shall be briefly described with reference to FIG. 7.

Figure 1:
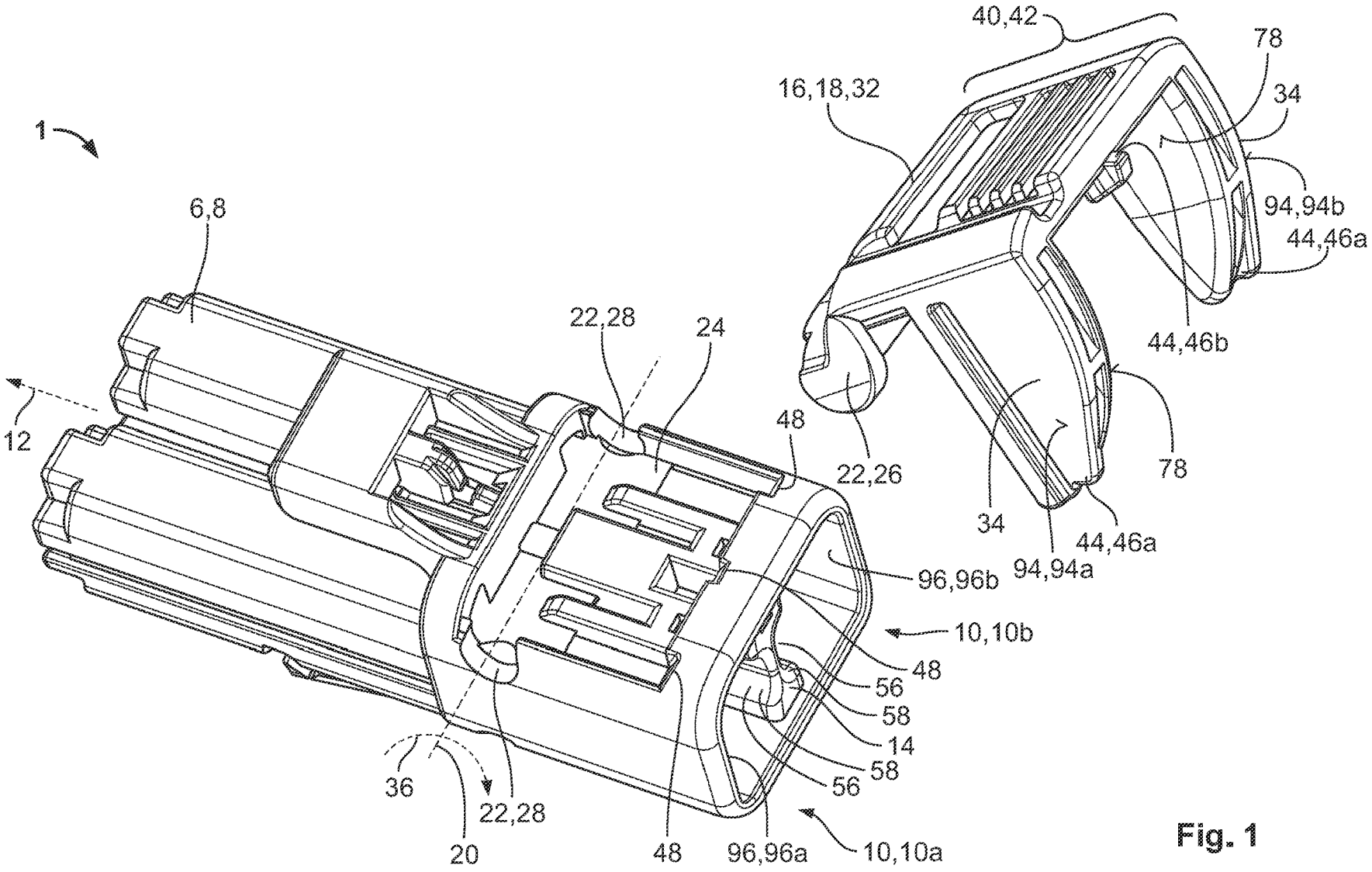
FIG. 1 is an exploded perspective view of a connector housing according to an embodiment.

The connector housing 1 according to the invention can be configured having two parts, as shown in FIG. 1. A first part 6 of the connector housing 1 is shaped as an elongate hollow part 8. At least one cable duct 10, for example, two cable ducts 10*a*, 10*b*, can lead through the hollow part 8 along a plug-in direction 12. The two cable ducts 10*a*, 10*b* can each be separated from one another in sections by a partition wall 14. The applicability of the invention can be expanded by the additional cable ducts 10. For example, individual cores of a two-core or multi-core electrical cable 30 can be passed each through one cable duct 10. The at least one partition wall 14 then ensures that the necessary air and creepage distances are maintained.

A second part 16 of the connector housing 1 can be an oscillation suppressor 18, as is likewise shown in FIG. 1, and can be pivoted about a pivot axis 20 into the two cable ducts 10*a*, 10*b*.

Figure 2:
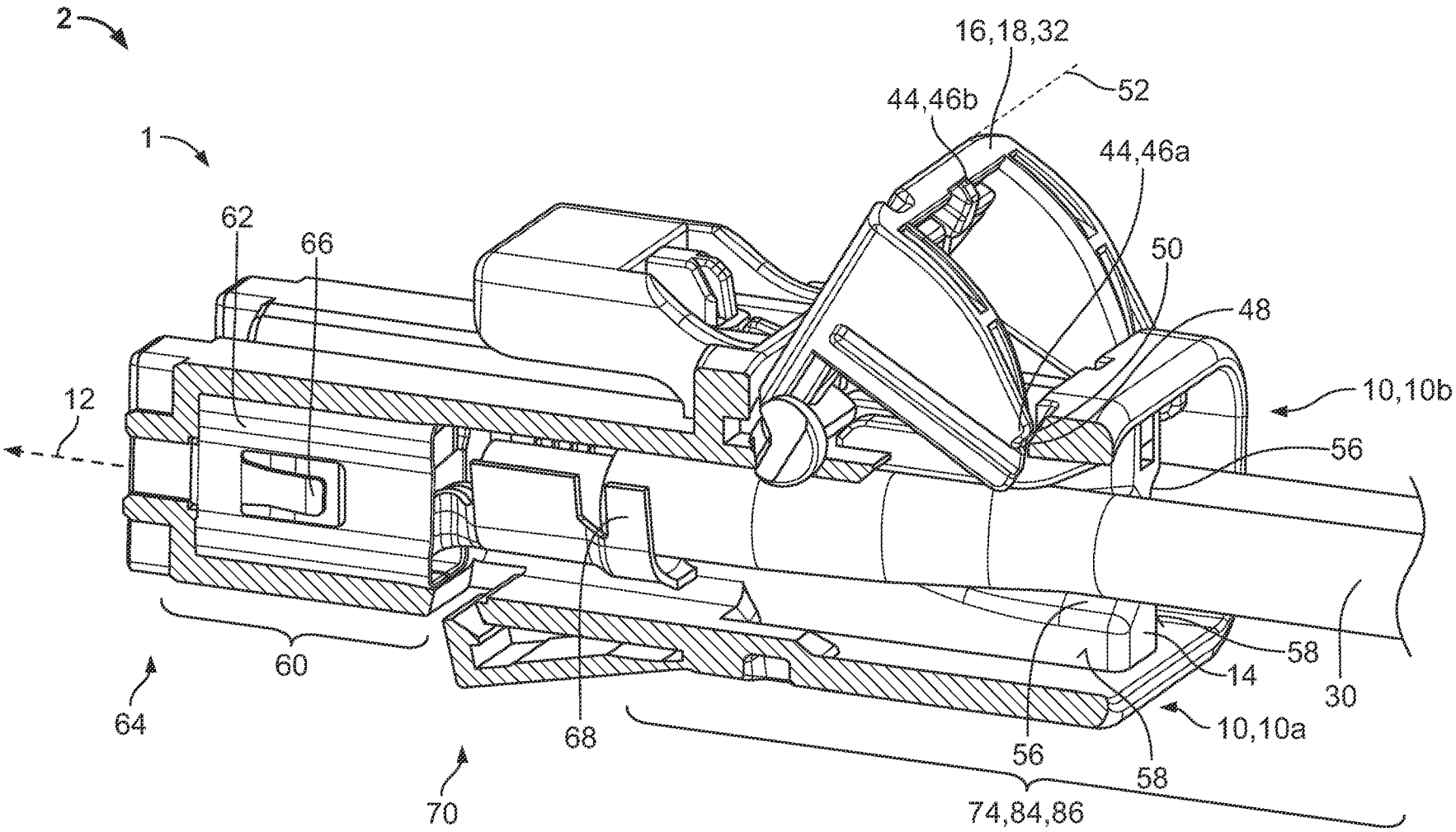
FIG. 2 is a sectional perspective view of an electrical plug connector according to an embodiment with an oscillation suppressor in a pre-pivot position.
Figure 3:
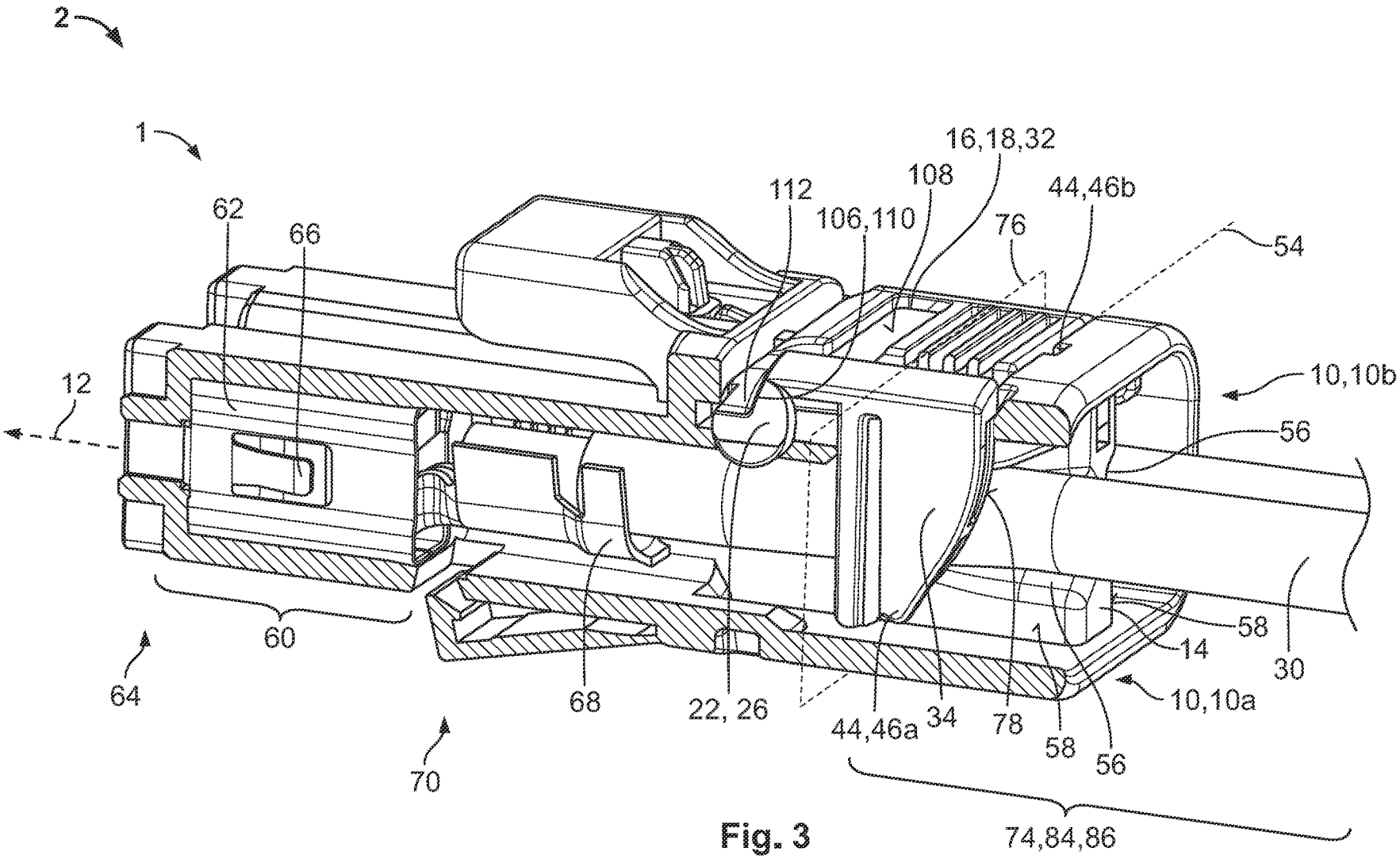
FIG. 3 is a sectional perspective view of the electrical plug connector of FIG. 2 with the oscillation suppressor in a pivoted state.

The pivot axis 20 is shown aligned perpendicular to the plug-in direction 12 only by way of example in FIGS. 1 to 3. The pivot axis 20 can also run parallel or at an angle to the plug-in direction 12.

The oscillation suppressor 18 is held to be pivotable by way of a hinge 22 on an outer side 24 of the hollow part 8. The hinge 22 can have at least one pin 26 and at least one hole 28 engaging around the pin 26. For reasons of symmetry, two or an even number of pins 26 and two or an even number of holes 28 can be provided. The holes 28 of the hinge 22 in FIG. 1 are shown partly open. Alternatively, the holes 28 or at least one hole 28 can be closed in the circumferential direction. Furthermore, the holes 28 can be arranged, for example, on the hollow part 8. The pins 26 are disposed correspondingly on the oscillation suppressor 18. Of course, this arrangement can also be reversed or mixed.

Alternatively, the oscillation suppressor 18 can also be attached to the outer side 24 of the hollow part 8 by way of an integral hinge or a snap hinge. In particular, the hollow part 8 and the oscillation suppressor 18 can be produced to be integrally formed.

In the embodiments shown in FIGS. 1 to 7, the connector housing 1 comprises only one oscillation suppressor 18. Depending on the number and position of electrical cables 30 to be passed through the connector housing 1, two or more oscillation suppressors can also be provided. In this case, the oscillation suppressors can be arranged on the connector housing 1 offset by uniform or non-uniform spacings in length. The offset can also be effected at uniform or non-uniform angular intervals.

Figure 5:
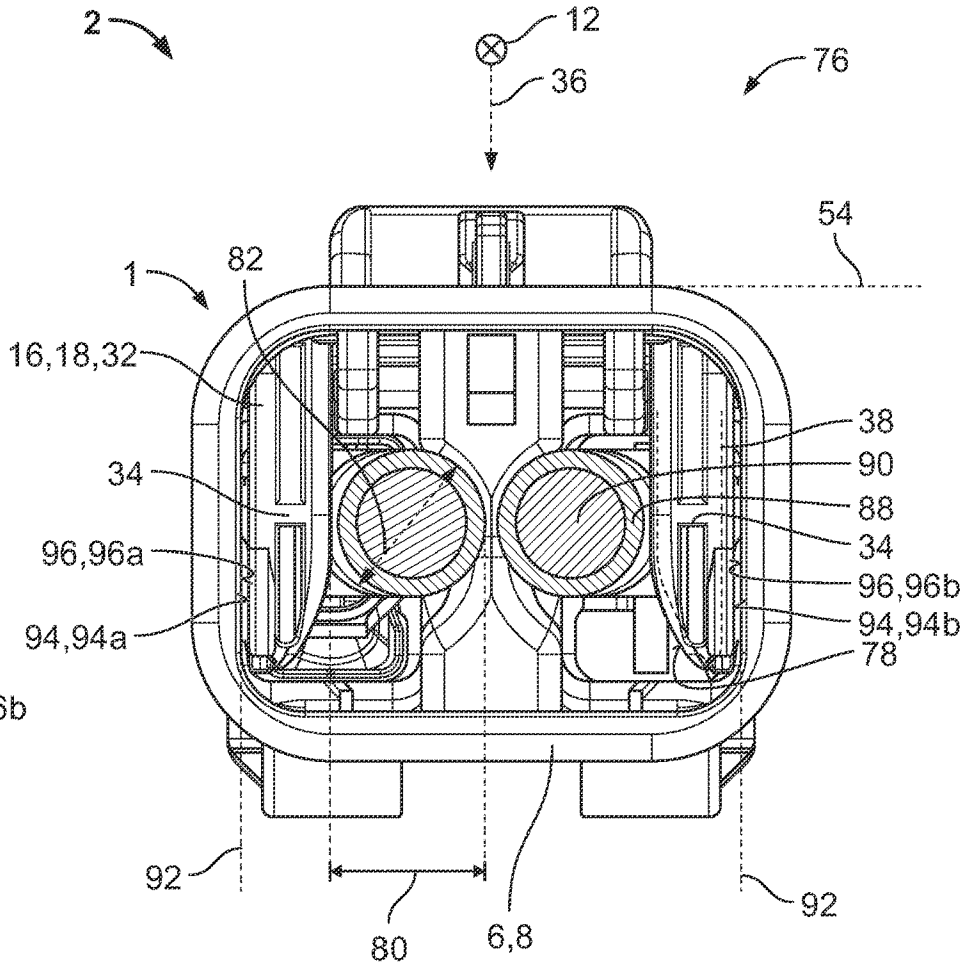
FIG. 5 is a sectional end view of the electrical plug connector of FIG. 2 with the oscillation suppressor in the pivoted state.

The oscillation suppressor 18 can have the shape shown in FIG. 1. In particular, the oscillation suppressor 18 can be configured as a clamping device 32 which comprises two leg-like projections 34. The leg-like projections 34 may also be referred to simply as projections 34. The leg-like projections 34 can be arranged such that a U-shaped profile arises in a cross section of the at least one oscillation suppressor 18 perpendicular to the plug-in direction 12. The leg-like projections 34 can be resilient. The leg-like projections 34 run parallel to one another and extend along a pivot direction 36. The leg-like projections 34 can each be configured having a wedge shape, in particular a wedge-shaped profile 38. As shown in FIG. 5, the wedge-shaped profile 38 can be curved and taper along the pivot direction 36, i.e., point perpendicular to the plug-in direction 12. A straight, wedge-shaped profile 38 is also possible in an embodiment.

As shown in FIG. 1, the oscillation suppressor 18 can furthermore comprise an arm 40 which is configured like a lever 42 and connects the leg-like projections 34 to the hinge 22.

As is also shown in FIG. 1, the oscillation suppressor 18 can comprise at least one, and in an embodiment several, latching elements 44. The latching elements 44 can protrude in the form of engagement tabs 46*a*, 46*b* on the oscillation suppressor 18, more precisely on the leg-like projections 34 and/or on the arm 40 of the oscillation suppressor 18. The engagement tabs 46*a* on the leg-like projection 34 can engage with outer edges 48 of the hollow part 8, i.e., establish a latching connection 50, so that the oscillation suppressor 18 can latch in a pre-pivot position 52 as shown in FIG. 2. The engagement tabs 46*b* on arm 40 can be used to latch the oscillation suppressor 18 in a pivoted state 54; this is shown in FIG. 3.

The at least one partition wall 14 can comprise notches 56 as shown in FIG. 1 which, for example, extend on two oppositely disposed sides 58 of the at least one partition wall 14 parallel to the plug-in direction 12.

As shown in FIG. 2, the hollow part 8 has contact chambers 60 which each serve to receive an electrical contact element 62. The contact chambers 60 are arranged at an axial end 64 of the hollow part 8. Each cable duct 10 opens into one contact chamber 60. As is further shown in FIG. 2, the connector housing 1 can be part of an electrical connector 2, wherein one electrical contact element 62 is held in each contact chamber 60 in a latching manner by way of latching spades 66. The respective electrical contact element 62 is crimped over a fastening portion 68, for example, onto one end 70 of an electrical cable 30. Alternatively, contact element 62 and cable 30 can also be connected by way of screwing, welding, or soldering.

The electrical cables 30, in the shown embodiment, pass through the associated cable duct 10, past the notches 56, and up to the respective contact chamber 60, as shown in FIG. 2. In other words, the electrical cables 30 can extend at least in sections parallel to the notches 56 through the associated cable duct 10.

When the oscillation suppressor 18 is in the pre-pivot position 52 shown in FIG. 2, the respective electrical cable 30 is arranged in a freely floating manner in the associated cable duct 10. The respective electrical cable 30 has a predefined natural frequency corresponding to the free-floating length 74. By pivoting the oscillation suppressor 18 into the pivoted state 54 shown in FIG. 3, the electrical cables 30 are clamped in a cross section 8 of the connector housing 1 perpendicular to the plug-in direction 12 between one leg-like projection 34 and the at least one partition wall 14. More specifically, the respective electrical cable 30 is clamped between an inner surface 78, i.e., a surface facing inwardly with respect to cable duct 10, of the respective leg-like projection 34 and the at least one partition wall 14. Thereby, the electrical cables 30 are also pressed into the respective notches 56 opposite to the projections 34 about the cable ducts 10. The notches 56 serve as a cable seat or a cable support. The electrical cable 30 can be pressed into the at least one notch 56 in a positive-fit manner from one direction by the at least one projection 34 of the at least one oscillation suppressor 18 for the purpose of a clamping fixation, whereby the freedom of motion of the electrical cable 30 is also restricted in other directions.

Figure 4:
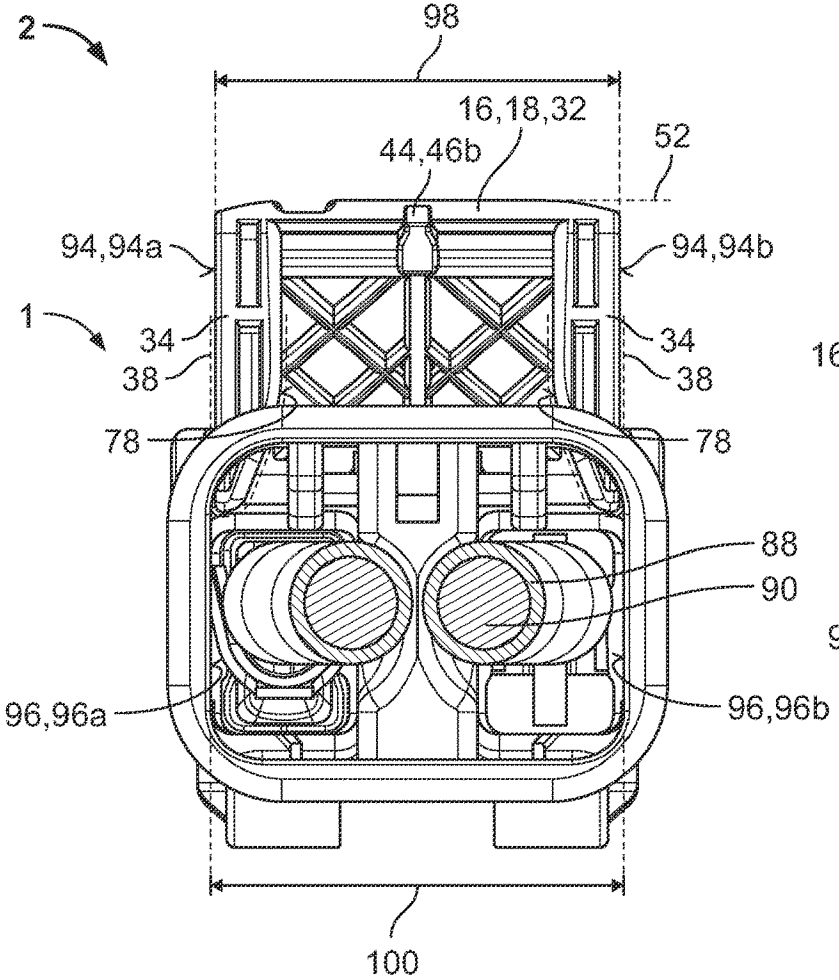
FIG. 4 is a sectional end view of the electrical plug connector of FIG. 2 with the oscillation suppressor in the pre-pivot position.

These states can be further understood in light of FIGS. 4 and 5. The wedge-shaped profiles 38 of the leg-like projections 34 protruding into the cable ducts 10 create here a continuous, stepless reduction of a clear width or dimension 80 of the respective cable duct 10. In addition, the amount of force required to pivot the at least one oscillation suppressor 18 is less.

In the pivoted state 54 of the at least one oscillation suppressor 18, the projections 34 extend perpendicular to the plug-in direction 12, so that the electrical cable 30 to be passed through can be clamped between the projections 34. The clear dimension 80 is reduced to a size that is equal to or smaller than the outer diameter 82 of the electrical cable 30 passed through the cable duct 10. The projections 34 are spaced at a distance which is equal in size to or smaller than the predefined outer diameter 82 of the electrical cable 30. Alternatively or in addition, a clear height, an inner diameter, the narrowest inner dimension or the shortest distance between two inner walls 96 of the corresponding cable duct 10 can also be reduced through the oscillation suppressor 18. The at least one projection 34 represents a measure for influencing the clear dimension 80 of the at least one cable duct, which can be easily implemented. This results in a simple structure of the connector housing 1.

In addition or alternatively, the at least one projection 34 can be configured as a resilient leg which is deflected and aligned by an inner wall 96 of the cable duct 10 when the at least one oscillation suppressor 18 is pivoted in. In particular, a force directed perpendicular to the plug-in direction 12 can thus be generated which increases the clamping, squeezing, pressing or holding force of the at least one oscillation suppressor 18.

As shown by comparison of FIGS. 2 and 3, a length 84 of a free-floating section 86 of the electrical cables 30 is shortened by being clamped with the oscillation suppressor 18. As a result, the electrical cables 30 are restricted in terms of their degrees of freedom of motion. The electrical cables 30 now have a changed, and in an embodiment higher, natural frequency. In particular, the susceptibility of the electrical cables 10, and of the electrical contact elements 62 attached thereto, to oscillations or vibrations is reduced. By raising the natural frequency, the occurrence of natural oscillations for the at least one electrical cable 30 and the at least one electrical contact element 62 connected thereto is shifted selectively to a higher frequency level, wherein this frequency level is outside the frequency range of the vibrations that are expected or typical for the application, respectively.

As shown in FIG. 5, a cable insulation 88 of the respective electrical cable 10 is clamped in the pivoted state 54 of the oscillation suppressor 18. If the hollow part 8 and the oscillation suppressor 18 are each made of electrically non-conductive materials, then an electrical conductor 90 of the respective electrical cable duct 10 can also be directly clamped.

It can also be seen in FIG. 5 that the oscillation suppressor 18 can be locked in the pivoted state 54 by at least one force-fit connection 92. More precisely, at least one outer surface 94, and in an embodiment two oppositely disposed outer surfaces 94*a*, 94*b* facing away from one another, can each establish the force-fit connection 92 with an inner wall 96*a*, 96*b* of the hollow part 8, respectively. For this purpose, the spacing 98 between the outer surfaces 94*a*, 94*b* can be equal in size to or greater than the spacing 100 between the inner walls 96*a*, 96*b*. Optionally, this can also be a frictionally engaged or positive substance-fit connection. In particular, in a cross section of the connector housing 1 perpendicular to the plug-in direction 12, an outer contour of the at least one oscillation suppressor 18 can be equal in size to or larger than an inner contour of the at least one cable duct 10. Adhesively bonding the at least one oscillation suppressor 18 in the pivoted state 54 is also possible if the pivoted state 54 is to be assumed, for example, permanently.

Figure 6:
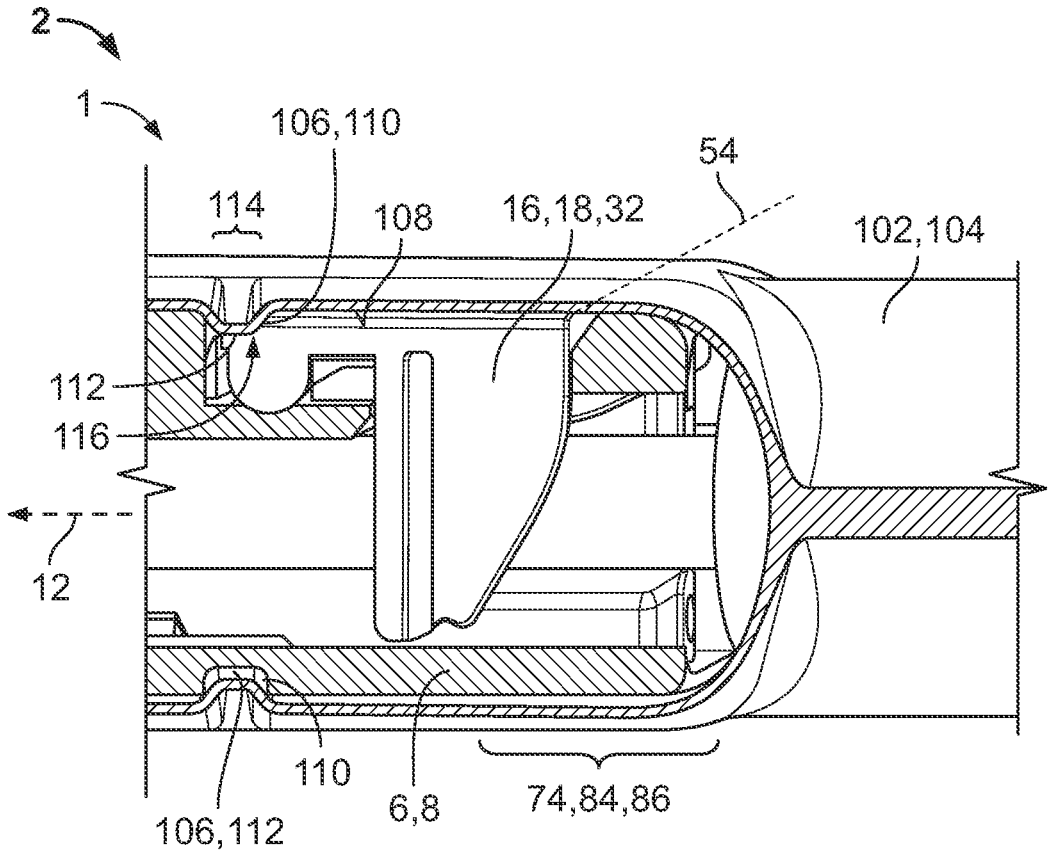
FIG. 6 is a detail sectional perspective view of the electrical plug connector with a locking device.

FIG. 6 shows an enlarged partial view of an electrical plug connector 2 according to the invention in a sectional illustration. As can be seen from this sectional illustration, the hollow part 8 and the oscillation suppressor 18 can be at least in part or entirely surrounded by a locking device 102. The locking device 102, in addition or alternatively to the latching elements 44 and/or the force-fit connection 92 explained above, holds the oscillation suppressor 18 in the pivoted state 54. The locking device 102 prevents the at least one oscillation suppressor 18 from being accidentally released, for example, due to vibrations or other external influences. In particular, a shielding sleeve 104 shielding against electromagnetic radiation can serve as a locking device 102.

To apply the locking device 102 shown in FIG. 6, the hollow part 8 and/or the oscillation suppressor 18 can comprise at least one positioning element 106 which is disposed on a lid surface 108 of the hollow part 8 and/or of oscillation suppressor 18 and forms a shoulder 110. In the exemplary embodiments shown, the at least one positioning element 106 is implemented by a recess 112 forming the shoulder 110 on the lid surface 108 of the oscillation suppressor 18. The locking device 102 can nestle against the at least one positioning element 106 formed as the shoulder 110 in order to affix the locking device 102 in the axial direction. In other words, a segment 114 of the locking device 102 can protrude into the recess 112 perpendicular to the plug-in direction 12, so that a positive-fit connection 116 is established which allows forces acting in the plug-in direction 12 to be absorbed.

Figure 7:
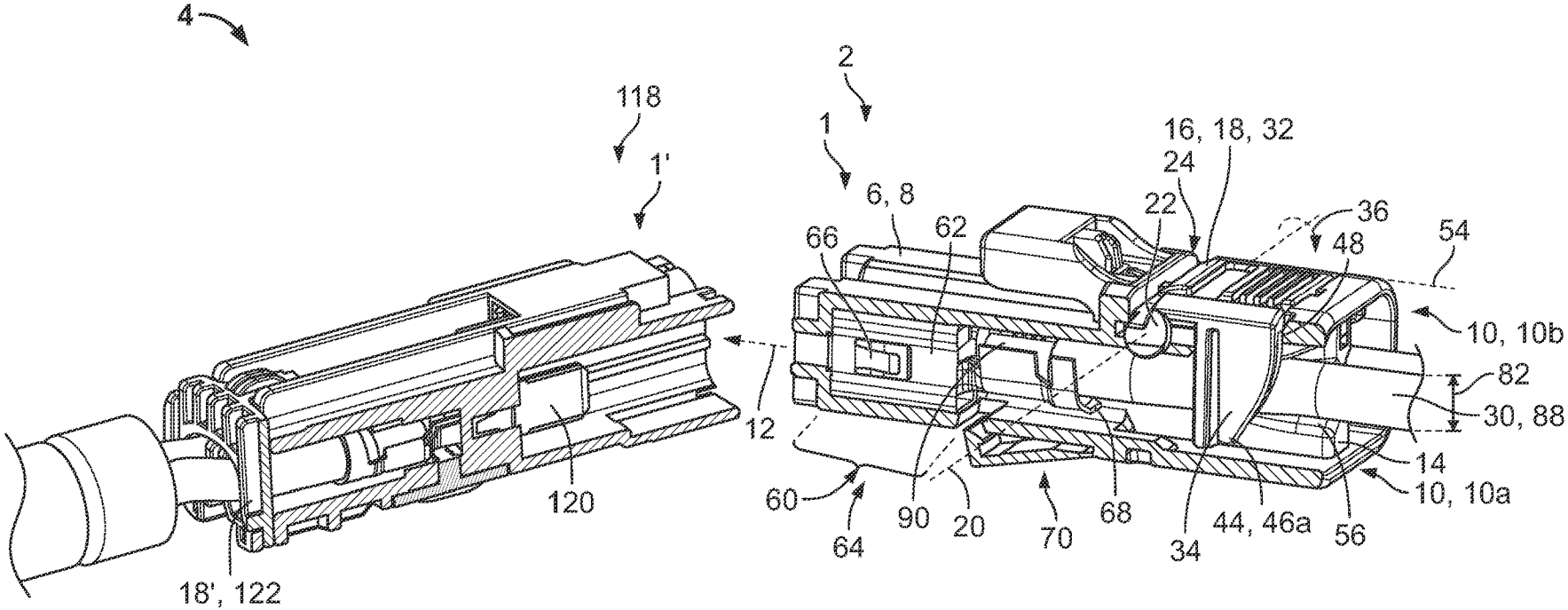
FIG. 7 is a sectional perspective view of an electrical plug connection according to an embodiment including the electrical plug connector.

In FIG. 7, an exemplary embodiment of the electrical plug connection 4 according to the invention is shown. The electrical plug connection 4 comprises an electrical plug connector 2 which is configured, for example, according to the above embodiments. Moreover, the electrical plug connection 4 comprises a mating connector 118 which is configured to be complementary to the electrical plug connector 2 and in which a mating contact 120 is provided for each electrical contact element 62 of the electrical plug connector 2. The mating connector 118 can further comprise an oscillation suppressor 18' configured as a slider 122. The slider 122 is introduced into the connector housing 1' of mating connector 118 by a translational sliding motion instead of a pivoting motion. The advantages explained above lead to increased vibration resistance and improved wear behavior of the electrical plug connection 4. In alternative embodiments, the oscillation suppressor 18 can also be configured as a pressing element or a cross section regulator.

Oscillation suppression is established by way of the at least one pivotable oscillation suppressor 18 after cable assembly, i.e., after the electrical cable 30 has been passed through. In particular, in the pivoted state 54 of the at least one oscillation suppressor 18, the electrical cable 30 passed through the at least one cable duct 10 can be clamped, squeezed, pressed or at least held in a contacting manner in the interior of the at least one cable duct 10 due to the resulting clear dimension 80. In other words, a subsequent reduction in the cross section 76 of the at least one cable duct 10 is used to affix the electrical cable 30 against vibrations. The at least one oscillation suppressor 18 can be implemented, for example, by a clamping device 32, a slider 122, a press-on element and/or a cross section regulator. During cable assembly, i.e., out of the pivoted state, the at least one oscillation suppressor 18 does not obstruct the passage of the electrical cable 30 through the at least one cable duct 10. The connector housing 1 thereby simplifies the production of electrical plug connectors 2 and, owing to the oscillation suppression, contributes to increasing the vibration resistance of electrical plug connectors 2.

What is claimed is:

1. A connector housing for an electrical plug connector, comprising:

a cable duct receiving an electrical cable of a predefined outer diameter along a plug-in direction;

an oscillation suppressor pivotable about a pivot axis into the cable duct, the cable duct in a cross section perpendicular to the plug-in direction has a clearance dimension in a pivoted state of the oscillation suppressor in the cable duct equal to or less than the predefined outer diameter of the electrical cable, the oscillation suppressor has a projection protruding into the cable duct in the pivoted state; and a hinge arranged on an exterior wall of the connector housing and defining the pivot axis, the oscillation suppressor pivotally connected to the housing via the hinge, the oscillation suppressor is pivotable about the hinge between a pre-pivot position and a pivoted position associated with the pivoted state, in the pre-pivot position the projection is arranged outside of the housing and in the pivoted position the projection extends through an opening formed through the housing and into the cable duct.

2. The connector housing of claim 1, wherein at least a portion of the oscillation suppressor is arranged on an outer side of the connector housing in the pivoted state of the oscillation suppressor.

3. The connector housing of claim 1, wherein the projection has a wedge shape.

4. The connector housing of claim 3, wherein the projection is disposed on an arm of the oscillation suppressor.

5. The connector housing of claim 4, wherein the arm of the oscillation suppressor is positioned outside of the housing in the pivoted state.

6. The connector housing of claim 1, further comprising a notch on a wall defining the cable duct.

7. The connector housing of claim 6, further comprising a pair of cable ducts extending in parallel.

8. The connector housing of claim 7, wherein the cable ducts are separated from one another by a partition wall, the notch is disposed on the partition wall.

9. The connector housing of claim 1, wherein the oscillation suppressor has a latching element latching in a pre-pivot position and/or in the pivoted state.

10. The connector housing of claim 1, further comprising a contact chamber sized to receive an electrical contact, the contact chamber arranged adjacent to and in communication with the cable duct in the plug-in direction, wherein the oscillation suppressor is pivotable about the hinge between a pre-pivot position and a pivoted position associated with the pivoted state, in the pre-pivot position at least a portion of the projection is arranged outside of the housing and in the pivoted position the projection extends into the cable duct.

11. The connector housing of claim 1, wherein the pivoting axis defined by the hinge is oriented perpendicular to the plug-in direction.

12. An electrical plug connector, comprising:

an electrical cable having a predefined outer diameter and a predefined natural frequency;

an electrical contact element arranged on an end of the electrical cable; and a connector housing including a cable duct receiving the electrical cable along a plug-in direction and an oscillation suppressor pivotable about a pivot axis into the cable duct, the cable duct in a cross section perpendicular to the plug-in direction has a clearance dimension in a pivoted state of the oscillation suppressor in the cable duct equal to or less than the predefined outer diameter of the electrical cable, the oscillation suppressor directly abuts a non-conductive portion of the electrical cable in the pivoted state.

13. The electrical plug connector of claim 12, wherein the electrical cable has a natural frequency higher than the predefined natural frequency in the pivoted state of the oscillation suppressor.

14. The electrical plug connector of claim 12, further comprising a locking device holding the oscillation suppressor in the pivoted state.

15. The electrical plug connector of claim 14, wherein the locking device at least partially surrounds the connector housing.

16. The electrical plug connector of claim 14, wherein the oscillation suppressor has a positioning element, the locking device abuts against the positioning element.

17. An electrical plug connection, comprising:

an electrical plug connector including an electrical cable having a predefined outer diameter and a predefined natural frequency, an electrical contact element arranged on an end of the electrical cable, and a connector housing including a cable duct receiving the electrical cable along a plug-in direction and an oscillation suppressor pivotable about a pivot axis into the cable duct, the cable duct in a cross section perpendicular to the plug-in direction has a clearance dimension in a pivoted state of the oscillation suppressor in the cable duct equal to or less than the predefined outer diameter of the electrical cable, the oscillation suppressor directly abuts a non-conductive portion of the electrical cable in the pivoted state; and a mating connector complementary to the electrical plug connector, the mating connector has a mating contact matable with the electrical contact element.

* * * * *